US011242647B2

(12) United States Patent
Kim et al.

(10) Patent No.: US 11,242,647 B2
(45) Date of Patent: Feb. 8, 2022

(54) CLOTHES TREATING APPARATUS

(71) Applicant: Samsung Electronics Co., Ltd, Suwon-si (KR)

(72) Inventors: Young Mi Kim, Suwon-si (KR); Kyung Ho Hwang, Anyang-si (KR); Jea Won Lee, Hwaseong-si (KR); Jong Ho Lee, Yongin-si (KR); Hwang Mook Cho, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 467 days.

(21) Appl. No.: 15/982,889

(22) Filed: May 17, 2018

(65) Prior Publication Data

US 2018/0334767 A1 Nov. 22, 2018

(30) Foreign Application Priority Data

May 18, 2017 (KR) ..... 10-2017-0061760

(51) Int. Cl.

| | |
|---|---|
| ***D06B 1/02*** | (2006.01) |
| ***D06B 23/04*** | (2006.01) |
| ***H04N 5/225*** | (2006.01) |
| ***D06F 58/10*** | (2006.01) |

(52) U.S. Cl.

CPC ..... *D06F 58/10* (2013.01); *D06B 1/02* (2013.01); *D06B 23/04* (2013.01); *H04N 5/225* (2013.01)

(58) Field of Classification Search

CPC ..... D06B 1/02; D06B 23/04; D06F 58/10; H04N 5/225

See application file for complete search history.

(56) References Cited

U.S. PATENT DOCUMENTS 3,672,188 A * 6/1972 Geschka ..... D06F 18/00 68/12.15
4,304,053 A * 12/1981 Kellerhals ..... D06F 73/02 34/225

(Continued)

FOREIGN PATENT DOCUMENTS

CN 101842529 A 9/2010
CN 204738145 U 11/2015

(Continued)

OTHER PUBLICATIONS

ISA/KR, "International Search Report," International Application No. PCT/KR2018/005599, dated Sep. 27, 2018, 3 pages.

(Continued)

*Primary Examiner* — Benjamin L Osterhout

(57) ABSTRACT

Disclosed herein is a clothes treating apparatus having a movable nozzle for spraying air jets to the garment hung on one or more hangers. The clothes treating apparatus includes a main body having a garment container, a door hinged with the main body to be rotated in front of the garment container and having a display on the front side of the door, a nozzle unit having a nozzle configured to spray air to a garment contained in the garment container, a nozzle transportation unit configured to reciprocate the nozzle unit, and a hose supplying air from a fan located on the bottom of the main body to the nozzle unit, wherein a direction of transportation of the nozzle unit intersects the direction of gravity.

17 Claims, 10 Drawing Sheets

(56) References Cited

U.S. PATENT DOCUMENTS

| | | | | |
|---|---|---|---|---|
| 5,359,786 | A * | 11/1994 | Vierling | D06F 73/02 34/218 |
| 5,516,012 | A * | 5/1996 | Weigel | D06F 73/02 223/51 |
| 5,555,640 | A * | 9/1996 | Ou | A47L 19/00 211/133.6 |
| 6,189,346 | B1 * | 2/2001 | Chen | D06F 58/10 68/205 R |
| 7,060,106 | B2 * | 6/2006 | Kleker | D06F 17/04 68/205 R |
| 7,137,211 | B2 * | 11/2006 | Johnson | D06F 58/10 34/381 |
| 9,062,403 | B2 | 6/2015 | Zaglio | |
| 9,469,934 | B2 * | 10/2016 | Alrefaei | A47G 25/14 |
| 9,790,638 | B2 * | 10/2017 | Song | D06F 73/02 |
| 2005/0115120 | A1 * | 6/2005 | Cevik | D06F 73/02 38/14 |
| 2005/0223502 | A1 * | 10/2005 | Kleker | D06F 17/04 8/158 |
| 2006/0101867 | A1 | 5/2006 | Kleker | |
| 2008/0034813 | A1 * | 2/2008 | Tobias | D06F 87/00 68/222 |
| 2012/0317729 | A1 | 12/2012 | Song et al. | |
| 2014/0223973 | A1 | 8/2014 | Alrefaei | |
| 2017/0292213 | A1 | 10/2017 | Lv et al. | |

FOREIGN PATENT DOCUMENTS

| | | | |
|---|---|---|---|
| CN | 205420848 | U | 8/2016 |
| KR | 20070109319 | A | 11/2007 |
| KR | 10-2009-0076511 | A | 7/2009 |
| KR | 10-2010-0066176 | A | 6/2010 |
| KR | 20110035030 | A | 4/2011 |
| KR | 10-2011-0099915 | A | 9/2011 |
| WO | 2016045179 | A1 | 3/2016 |

OTHER PUBLICATIONS

Notice of Preliminary Rejection dated Jul. 14, 2021 in connection with Korean Patent Application No. 10-2017-0061760, 12 pages.
Office Action dated Oct. 21, 2021 in connection with Chinese Patent Application No. 201880047923.9, 13 pages.
Notice of Allowance dated Nov. 7, 2021 in connection with Korean Patent Application No. 10-2017-0061760, 3 pages.

* cited by examiner

CLOTHES TREATING APPARATUS

CROSS-REFERENCE TO RELATED APPLICATION

This application is based on and claims priority under 35 U.S.C. § 119 to Korean Patent Application No. 10-2017-0061760 filed on May 18, 2017 in the Korean Intellectual Property Office, the disclosure of which is incorporated herein by reference in its entirety.

BACKGROUND

1. Field

Embodiments of the present disclosure relate to a clothes treating apparatus. More particularly, the embodiments relate to a clothes treating apparatus having a movable nozzle for spraying air jets to the garment hung on one or more hangers.

2. Description of Related Art

A clothes treating apparatus may refer to a device to perform clothes care that can remove dirt and/or odor or wrinkles from the clothes. The clothes treating apparatus may also be referred to as a clothes treatment apparatus or a laundry treating apparatus.

The clothes treating apparatus may remove the dirt and/or odor from the clothes by spraying air, hot air, or steam to the garment to be processed. The clothes treating apparatus may also remove the wrinkles from the clothes by spraying air, hot air, or steam to the garment to be processed.

SUMMARY

In accordance with one aspect of the present disclosure, a clothes treating apparatus includes a main body having a garment container, a door hinged with the main body to be rotated in front of the garment container and having a display on the front side of the door, a nozzle unit having a nozzle configured to spray air to a garment contained in the garment container, a nozzle transportation unit configured to reciprocate the nozzle unit, and a hose supplying air from a fan located on the bottom of the main body to the nozzle unit, wherein a direction of transportation of the nozzle unit intersects the direction of gravity.

The garment container may include a bar, on which a hanger is hung, located below the nozzle unit in the direction of gravity, and wherein the nozzle unit may be transported by reciprocating motion along the bar.

The door may include a camera on the rear side configured to capture the inside of the garment container.

The main body may include an inner case and an outer case, and wherein the nozzle transportation unit may be located between the inner case and the outer case.

The nozzle transportation unit may include a pulley rotated by power of a motor, a belt moved by contacting the pulley, a moving block moved on a rail by the belt, and a bracket coupling the nozzle unit to the moving block.

The clothes treating apparatus may further include stoppers located at both ends of the rail and limiting the movement of the moving block.

A portion of the bracket may be coupled to the nozzle unit by penetrating the inner case of the main body from outside of the inner case.

The nozzle unit may have an open structure at one end for receiving the air from the hose and a closed structure at the other end, and wherein a plurality of nozzles may be formed on the bottom of the nozzle unit.

The bottom of the nozzle unit may be slanted at a first set angle, which is an acute angle, from the direction of gravity.

The nozzles may be arranged in one of a single array and multiple arrays on the bottom of the nozzle unit slanted at the first set angle.

The nozzle may be configured to spray air while being slanted at a second set angle, which is an acute angle, from the direction of gravity.

The first set angle may be the same as or different from the second set angle.

In response to reciprocating motion of the nozzle unit, the entire length of the hose connected from the fan located in a middle area on the bottom of the main body to the nozzle unit may vary due to elasticity of a portion of the hose.

When the fan is located on a side of the bottom of the main body, the entire length of the hose connected from the fan to the nozzle unit may be constant.

The bar may have a groove formed thereon to receive the hanger, and wherein the garment hung on the hanger received in the groove may be swayed by the air sprayed from the nozzle of the nozzle unit.

In accordance with one aspect of the present disclosure, a clothes treating apparatus includes a main body having a garment container containing a garment hung on a hanger, a door hinged with the main body to be rotated in front of the garment container and having a touch screen on the front side of the door, a nozzle unit having a nozzle configured to spray air to the garment contained in the garment container, a nozzle transportation unit configured to reciprocate the nozzle unit, a fan connected to a hose which supplies the air to the nozzle unit and located on the bottom of the main body, and a controller configured to control the touch screen, the nozzle transportation unit, and the fan, wherein the controller is configured to use the nozzle transportation unit to reciprocate the nozzle unit to intersect with the direction of gravity in response to a user input received through the touch screen, and control the air supplied from the fan to be sprayed to the garment container through the nozzle of the nozzle unit coupled to the nozzle transportation unit.

The clothes treating apparatus may further include a camera located on the rear side of the door, wherein the controller may be configured to use the camera to change a distance of movement of the nozzle unit coupled to the nozzle transportation unit based on the number of garments contained in the garment container.

The controller may be configured to use the camera to change a set speed of the nozzle unit coupled to the nozzle transportation unit based on the number of garments contained in the garment container.

The controller may be configured to change the number of rotations of the fan that supplies the air, in response to the user input.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document. Those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
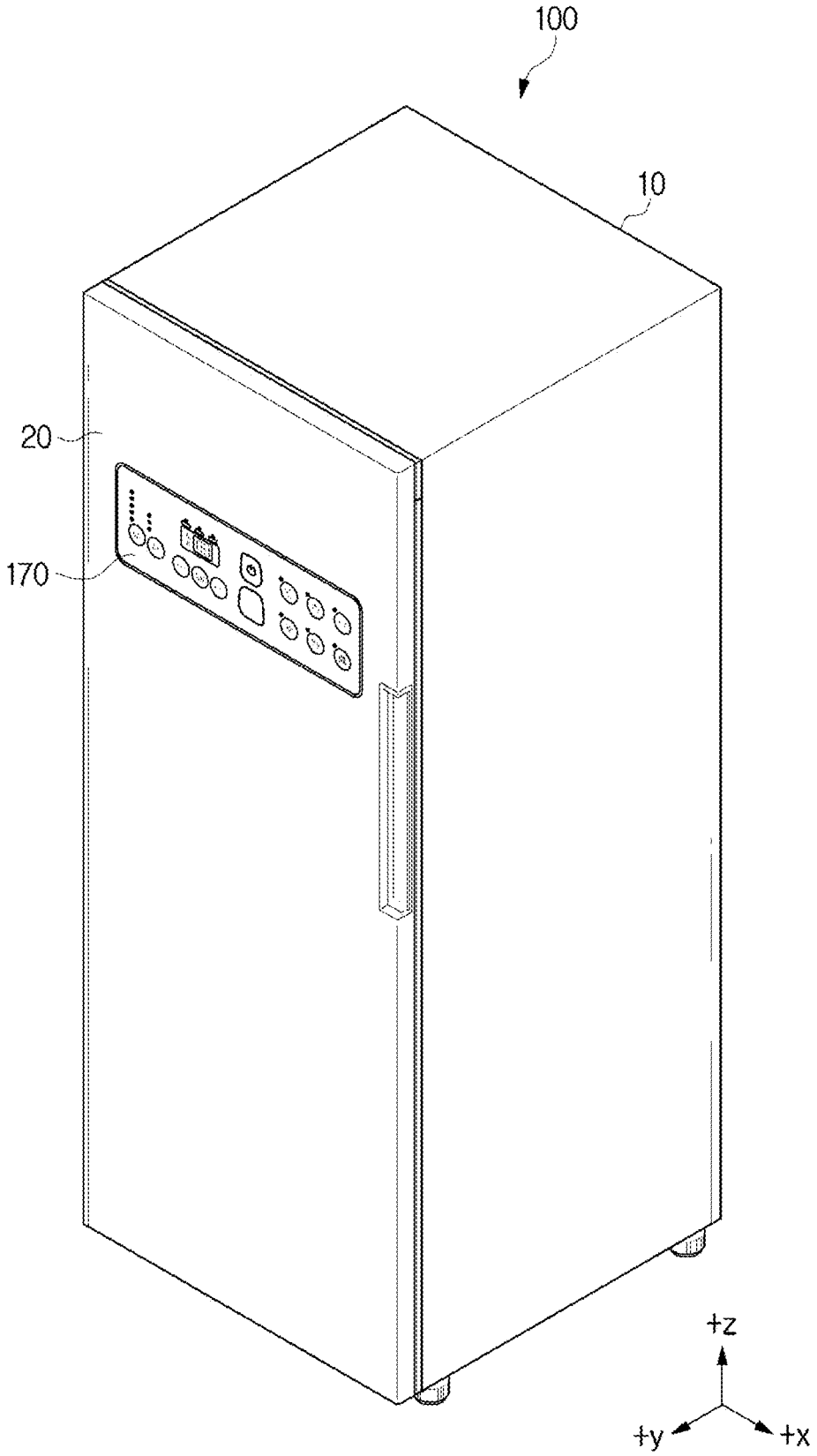
FIG. 1 illustrates a schematic perspective view of a clothes treating apparatus, according to an embodiment of the present disclosure.

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

The present disclosure will now be described more fully with reference to the accompanying drawings, in which various embodiments of the disclosure are shown. Methods for manufacturing and using the embodiments of the present disclosure will also be described in detail below with reference to the accompanying drawings. Throughout the drawings, like reference numerals refer to like parts or components.

It will be understood that, although the terms first, second, third, etc., may be used herein to describe various components, these components should not be limited by these terms. These terms are only used to distinguish one element, component, region, layer or section from another region, layer or section. Thus, a first element, component, region, layer or chamber discussed below could be termed a second element, component, region, layer or section without departing from the teachings of the present disclosure. Descriptions shall be understood as to include any and all combinations of one or more of the associated items when the items are described by using the conjunctive term "and/or," or the like.

An application in accordance with an embodiment of the present disclosure refers to software that runs on a computer-based operating system (OS) or a mobile-based OS to be used by the user. For example, the application may include a web browser, a camera application, a mobile payment application (an electronic payment application or a payment application), a photo gallery application, a word processor, a spread sheet, a contacts application, a calendar application, a memo application, an alarm application, a social network service (SNS) application, a call application, a game store, a game application, a chat application, a map application, a music player, a video player, etc.

In embodiments of the present disclosure, the application may refer to a clothes treating apparatus, or software running in an external device (e.g., a wearable device, a portable device such as a smart phone, a server, or the like) connected wirelessly or wiredly to the clothes treating apparatus. Alternatively, the application may refer to software that runs in the clothes treating apparatus in response to an input received from the user.

Content may be carried out or displayed through a corresponding application. For example, the content may include a video file or audio file played by an application, e.g., a video player, a game file carried out by a game application, a music file played by a music player, a photo file presented in a photo gallery application, a web page file presented by a web browser, payment information (e.g., a mobile card serial number, money to be paid, a product name, a service name, a store name, or the like) presented by an electronic payment application, etc.

The content may include an application screen (or a running widget) and a user interface that forms the application screen. There may be a single content or multiple contents.

A widget refers to a mini application, which is one of graphic user interfaces (GUIs) to support smoother interaction between the user and the application or the OS. For example, there may be a weather widget, a calculator widget, a clock widget, etc.

In embodiments of the present disclosure, the term 'user input' may be used as including the user's button (or key) selection, the user's button (or key) pressure or clicking, the user's soft button (or key) touch, the user's touch (including non-contact based touch like hovering) received (or detected) at the touch screen, the user's touch gesture (including non-contact based gesture like hovering) received (or detected) at the touch screen, the user's voice, the user's presence, e.g., appearance of the user within a camera recognition range, or the user's motion. Furthermore, the term 'button (or key) selection' may be used as referring to pressure (or clicking) on a button (or key) or touch on a soft button (or soft key).

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. Like reference numerals in the drawings denote like elements, and thus their description will be omitted.

FIG. 1 illustrates a schematic perspective view of a clothes treating apparatus, according to an embodiment of the present disclosure.

Figure 2:
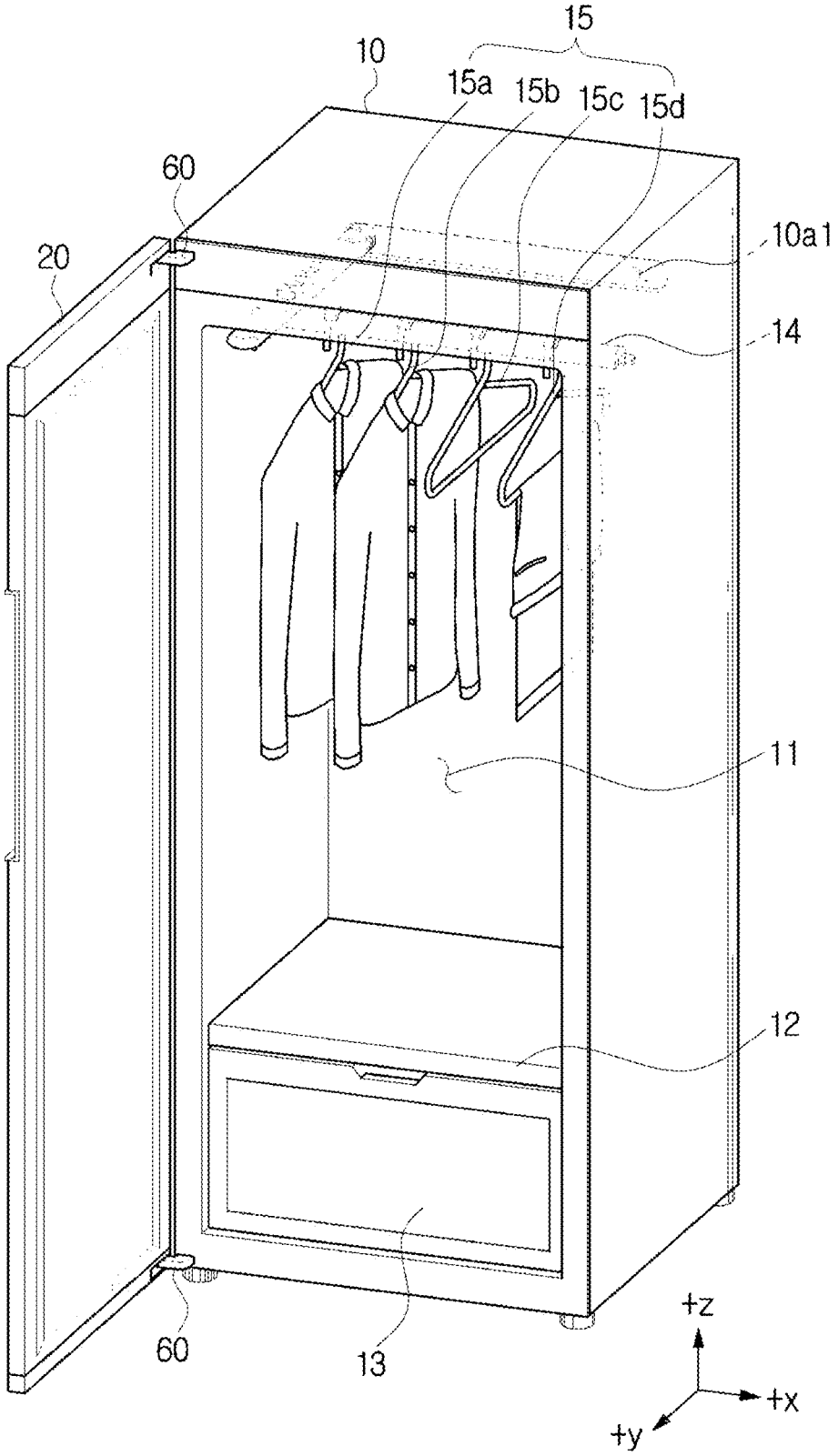
FIG. 2 illustrates a schematic perspective view of a clothes treating apparatus with the door open, according to an embodiment of the present disclosure.

FIG. 2 illustrates a schematic perspective view of a clothes treating apparatus with the door open, according to an embodiment of the present disclosure.

Referring to FIGS. 1 and 2, a clothes treating apparatus 100 may include a main body 10, a garment container 11, a door 20, and a hinge 60 to couple the door 20 to the main body 10. A display (or a touch screen) 170 capable of receiving the user's input (e.g., touch or button selection) and displaying a screen of an application (or widget) may be located on the front side of the door 20.

A button (or buttons) may be integrated with the display 170 or may be separated from the display 170. The button may include a button displayed on the display 170, a touch button, or a physical button. Furthermore, garment processing options (or menus) selectable by the user, operating time, remaining time, etc., may be displayed on the display 170. The display 170 may also be referred to as an operation panel.

A proximity sensor 163 (see FIG. 3) may be located adjacent to the display 170 (e.g., within a radius of about 300 mm, which may be changed by the manufacturer) to detect the approximation of the user. Furthermore, there may be a microphone 140 (see FIG. 3) located on the front side of the door 20 to receive a voice spoken by the user.

The clothes treating apparatus 100 may include a partition 12 to separate the garment container 11 and a water storage 13 under the garment container 11. The water storage 13 may include a water supply tank (now shown) for supplying water to a steam jet nozzle (not shown) that supplies steam into the garment container 11 and/or a drain tank (not shown) to collect moisture from inside the garment container 11. In an embodiment of the present disclosure, the water storage 13 may be optionally implemented (e.g., may be installed or not installed) in the clothes treating apparatus 100. Alternatively, the clothes treating apparatus 100 may not include the partition 12 that separates the water storage 13.

The clothes treating apparatus 100 may be classified by the number of doors. The clothes treating apparatus 100 may have a single door (see FIG. 1) or two doors (not shown), a first door on the left and a second door on the right like the French door refrigerator.

The main body 10 includes an inner case 10*a* (see FIG. 4) forming the garment container 11, and an outer case 10*b* (also see FIG. 3) forming the exterior of the clothes treating apparatus.

The garment container 11 has a bar 14 at the upper end. Both ends of the bar 14 may be fixed to both sides of the garment container 11. One or more hangers 15 may be hung on the bar 14. One or more garments (e.g., including pants) may be hung on the hanger 15.

A nozzle transportation unit 188 may be fixed to the both sides of the garment container 11. The nozzle transportation unit 188 may enable a nozzle unit 185 for spraying air jets to the garment to make reciprocating motion (e.g., along ±x-axis). In an embodiment of the present disclosure, the air jets may correspond to air with the atmospheric pressure or higher pressure than the atmospheric pressure.

An opening 10*a*1 may be formed at the upper end of the back of the inner case 10*a* (e.g., along the −y-axis). A portion of a hose 186 may be coupled to a side of the nozzle unit 185 through the opening 10*al*.

The door 20 may be rotated within an angle set by the hinge 60 (e.g., about 300° or less) to open or close the front of the garment container 11.

A camera 150 (see FIG. 3) may be located on at least one of the front side (e.g., along the +y-axis) and the rear side (e.g., along the −y-axis) of the door 20. In a case that the camera 150 is located on the front side of the door 20, the camera 150 may capture approximation of the user. Otherwise, in a case that the camera 150 is located on the rear side of the door 20, the camera 150 may capture a garment condition (e.g., the number of clothes hung on the hanger or the extent of contamination of the garment) and/or a garment process (e.g., whether air jets are being sprayed from a nozzle, a moving condition of the nozzle unit, the extent of removal of contamination of the garment, etc.). In an embodiment of the present disclosure, the camera 150 may be an indoor camera located on the rear side of the door 20.

Figure 3:
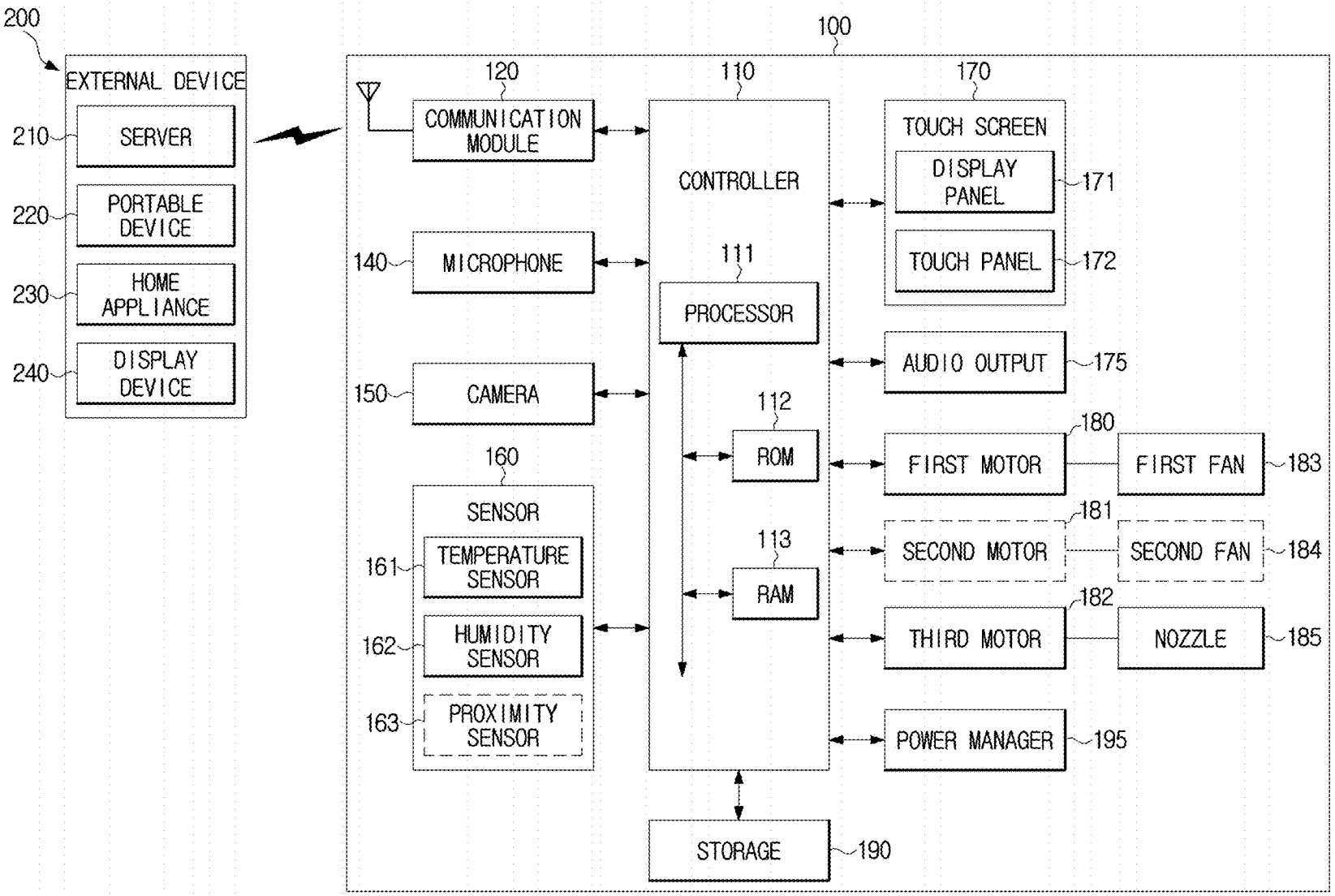
FIG. 3 illustrates a schematic block diagram of a clothes treating apparatus, according to an embodiment of the present disclosure.

FIG. 3 illustrates a schematic block diagram of a clothes treating apparatus, according to an embodiment of the present disclosure.

Referring to FIG. 3, the clothes treating apparatus 100 may use a communication module 120 to be functionally connected to an external device 200. The external device 200 may include a server 210, a portable device 220 including a smart phone, a home appliance 230 including an air conditioner, a washer, etc., or a display device 240 including a television.

The clothes treating apparatus 100 may send operation information corresponding to operation of the clothes treating apparatus 100 (e.g., spraying of air jets) or condition information corresponding to a condition of the clothes treating apparatus 100 (e.g., normal or abnormal condition) to the external device 200, or receive control information (e.g., a control instruction corresponding to the spraying of air jets by the clothes treating apparatus 100) from outside.

The clothes treating apparatus 100 may include a controller 110, the communication module 120, the microphone 140, the camera 150, a sensor 160, the display 170, an audio output 175, a first motor 180, a storage 190, and a power manager 195. For example, the sensor 160 may include a temperature sensor 161, a humidity sensor 162, or a proximity sensor 163.

The controller 110 may include a processor 111. Furthermore, the controller 110 may include a non-volatile memory including a read only memory (ROM) 112 to store a control program to control the clothes treating apparatus 100 and a volatile memory including a random access memory (RAM) 113 used as a storage area for various tasks performed by the clothes treating apparatus 100. The RAM 113 may be used as a storage area for control information received from outside, operation information of the clothes treating apparatus 100, or condition information of the clothes treating apparatus 100.

The controller 110 may control general operation of the clothes treating apparatus 100 and signal flows between the internal components (110 to 195) of the clothes treating apparatus 100, and process the data. The controller 110 may use the power manager 195 to control power to be supplied to the internal components 120 to 195. The processor 111, the ROM 112, and the RAM 113 may be interconnected by a bus.

The controller 110 may control the communication module 120, the microphone 140, the camera 150, the sensor 160, the display 170, the audio output 175, the first motor 180, the storage 190, and the power manager 195.

In embodiments of the present disclosure, the term 'controller of a (the) clothes treating apparatus' may be interpreted as having the processor 111, the ROM 112, and the RAM 113. Alternatively, the 'controller of a (the) clothes treating apparatus' may refer to the processor 111 only.

The communication module 120 may use one or more antennas to be connected to the external device 200 (210 to 240) over a mobile communication network, a wireless local area network (WLAN) or a short-range communication network under the control of the controller 110. The WLAN communication may enable the communication module 120 to be wirelessly connected to an Access Point (AP) in an area where the AP is installed, under the control of the controller 110. For example, the WLAN communication may include Wi-Fi communication.

The short-range communication may include bluetooth communication, bluetooth low energy communication, infrared data association (IrDA), ultra wide band (UWB) communication, magnetic security transfer (MST) communication and/or near field communication (NFC).

In various embodiments of the present disclosure, the term 'communication module' may refer to a device to be connected to an external device through mobile communication, WLAN communication and/or short-range communication.

The microphone 140 may convert a voice or sound received from outside to an electric signal under the control of the controller 110. Under the control of the controller 110, the electric signal produced from the microphone 140 may be converted by an audio codec to an analog signal, and stored in the storage 190 or output through the audio output 175. Furthermore, the user may input his/her voice through the microphone 140. The controller 110 may control operation of the clothes treating apparatus 100 (e.g., power on/off, spraying of air jets, etc.) by a control instruction corresponding to the user's voice.

The camera 150 may capture a still image or a moving image under the control of the controller 110. The camera 150 may capture a still image or a moving image for garment processing or treatment.

The camera 150 may be located on the rear side of the door 20 to take images of the inside of the clothes treating apparatus 100. The camera 150 may further include an extra front camera (not shown) on the front side of the door 20.

There may be one or more cameras that take images of the inside of the garment container 11. The camera 150 may be one or multiple in number depending on the size of the garment container 11, and may be located on the rear side of the door 20 facing the garment container 11 along the direction of gravity, i.e., along the −z-axis. For example, the camera 150 may include at least one of a first camera (not shown) corresponding to a first location on the rear side of the door 20 which faces the bar 14, a second camera (not shown) corresponding to a second location on the rear side of the door 20 which faces a third point of the garment container 11 with respect to the top of the garment container 11 in the direction of gravity, and a third camera (not shown) corresponding to a third location on the rear side of the door 20 which faces a half point of the garment container 11 from the top of the garment container 11 in the direction of gravity.

The controller 110 may control the image (or the video) captured by the camera 150 to be stored in the storage 190.

The sensor 160 may detect a surrounding condition of the clothes treating apparatus 100 (e.g., an intensity of illumination) and/or an internal condition of the clothes treating apparatus 100 (e.g., a temperature of the container).

The sensor 160 may include one or more temperature sensors 161 to detect the temperature of the garment container 11 of the clothes treating apparatus 100, one or more humidity sensors 162 to detect the humidity of the garment container 11, and/or the proximity sensor 163 to detect approximation of the user to the clothes treating apparatus 100.

It should be understood that a type of sensor included in the sensor 160 may be added, modified, or omitted depending on the performance of the clothes treating apparatus 100.

The touch screen (or the display) 170 may provide a GUI corresponding to various services, e.g., taking pictures, viewing video content, making a voice call, making a video call, sending data, receiving broadcast data, making electronic payment including mobile payment. In embodiments of the present disclosure, the touch screen 170 may be interpreted as having the display.

The touch screen 170 may include a touch panel 172 for receiving the user input, e.g., a touch of the user, and a display panel 171 for displaying a screen. In the touch screen 170, the display panel 171 and the touch panel 172 may be integrally implemented (e.g., as an in-cell type touch screen or an on-cell type touch screen).

The touch screen 170 may even include an edge touch panel (not shown) for receiving the user input and an edge display panel (not shown) for displaying a screen. The edge touch panel and the edge display panel may be integrally implemented as well.

The touch screen 170 may send an analog signal corresponding to a single touch or multiple touches input through a home screen (not shown) or a GUI to a touch screen controller (not shown). The touch screen 170 may receive the single touch or multiple touches of the user's body part (e.g., digit including thumb) or an input pen (e.g., a stylus pen, not shown).

The touch screen controller converts the analog signal corresponding to the touch (single touch or multiple touches) received from the touch screen 170 to a digital signal, and sends the digital signal to the controller 110. The controller 110 may use the digital signal received from the touch screen controller to calculate a point of the touch on the touch screen, e.g., XY coordinates.

The controller 110 may use the digital signal received from the touch screen controller to control the touch screen 170. For example, the controller 110 may control a shortcut icon (or just called an icon) selected from shortcut icons corresponding to applications displayed on the touch screen 170 in response to the input touch to be displayed separately from other non-selected shortcut icons, or control a video application screen to be displayed on the touch screen 170 by running an application, e.g., a video application, corresponding to the selected shortcut icon.

The audio output 175 outputs sound corresponding to various signals (e.g., wireless signals, broadcast signals, audio sources, video files, pictures taken, etc.) decoded by an audio codec under the control of the controller 110. The audio output 175 may include one or more speakers.

The one or more audio outputs 175 may be located on the front and/or the side of the clothes treating apparatus 100. Alternatively, the one or more audio outputs 175 may be located adjacent to the touch screen (or display) 170 provided on the front of the clothes treating apparatus.

A first motor 180 functionally coupled to a first fan 183 may be driven under the control of the controller 110. The first fan 183 receiving rotational force from the first motor 180 through e.g., a belt, a gear, coupling, or the like, may supply air jets to the hose 186 and the nozzle unit 185.

A second motor 181 functionally coupled to a second fan 184 may operate under the control of the controller 110. The second fan 184 receiving rotational force from the second motor 181 through e.g., a belt, a gear, coupling, or the like, may suck in air including dirt or odor from the inside of the garment container 11. The second fan 184 may be located in an opening (not shown) of the bottom, e.g., the partition 12, of the garment container 11. There may be a filter having multiple layers (not shown) located in front of the second fan 184, e.g., in the +z-axis direction, but the filter may be located in any other direction. The air including dirt, odor, etc., floating in the garment container 11 may be purified by the filter.

A third motor 182 of the nozzle transportation unit 188 may move the nozzle unit 185 fixed to a moving block 188*a* of the nozzle transportation unit 188. The third motor 182 may reciprocate the moving block 188*a* to which the nozzle unit 185 is fixed in the nozzle transportation unit 188 along a rail 188*e* (see FIG. 5) using a pulley 188*c* (also see FIG. 5) and a belt 188*d* (also see FIG. 5).

At least one of dirt, odor, and contamination of clothes hung on the hangers 15 in the garment container 11 may be handled by spraying air jets from the nozzle 185*a* of the nozzle unit 185.

The at least one of dirt, odor, and contamination of clothes hung on the hangers 15 in the garment container 11 may be handled by using air jets sprayed from the nozzle 185*a* of the reciprocating nozzle unit 185.

The clothes treating apparatus 100 may include deodorizer (not shown). The clothes treating apparatus 100 may further include an air purifier (not shown) to sterilize or get rid of the bacteria sticking or floating in the garment container 11, under the control of the controller 110. The air purifier may include an ion sterilization purifier.

The storage 190 may store signals or data corresponding to e.g., garment management (or garment recognition), which is input or output according to operation of the components 110 to 195, under control of the controller 110. The storage 190 may store a control program for controlling the clothes treating apparatus 100 or the controller 110, and a GUI related to an application downloaded from outside (e.g., a garment processing application or a garment-specific application), images corresponding to the GUI, user information, documents, databases, or associated data.

The storage 190 may store garment images (or videos) taken by the camera 150. The user may check the extent of contamination or dirt of the garment through the garment image (or video) displayed on the display 170. The controller 110 may recognize the extent of contamination, dirt, and/or odor of the garment through the camera 150 and/or the sensor 160. Furthermore, the controller 110 may recognize the extent of contamination, dirt, and/or odor of the garment through the camera 150 and/or the sensor 160 using a learning model of machine learning (or deep learning).

The garment image or video may include one or more images displayed on the display 170 and a binary file corresponding to the one or more images stored in the storage 190.

In embodiments of the present disclosure, the term 'storage' may include the storage 190, the ROM 112 in the controller 110, the RAM 113, or a memory card (not shown) such as a micro secure digital (SD) card that may be inserted to a slot (not shown) of the clothes treating apparatus 100. The storage 190 may also include a non-volatile memory, a volatile memory, a hard disc drive (HDD), or a solid state drive (SSD).

The power manager 195 may supply power to the components 110 to 195 of the clothes treating apparatus 100 under control of the controller 110. The power manager 195 may supply power to the respective components of the clothes treating apparatus 100 from an external power source through a power cord (not shown) under the control of the controller 110.

It should be understood that at least one of the components of the clothes treating apparatus 100 as shown in FIGS. 1, 2, and 3 may be added, deleted, or modified depending on the performance of the clothes treating apparatus 100.

Figure 4:
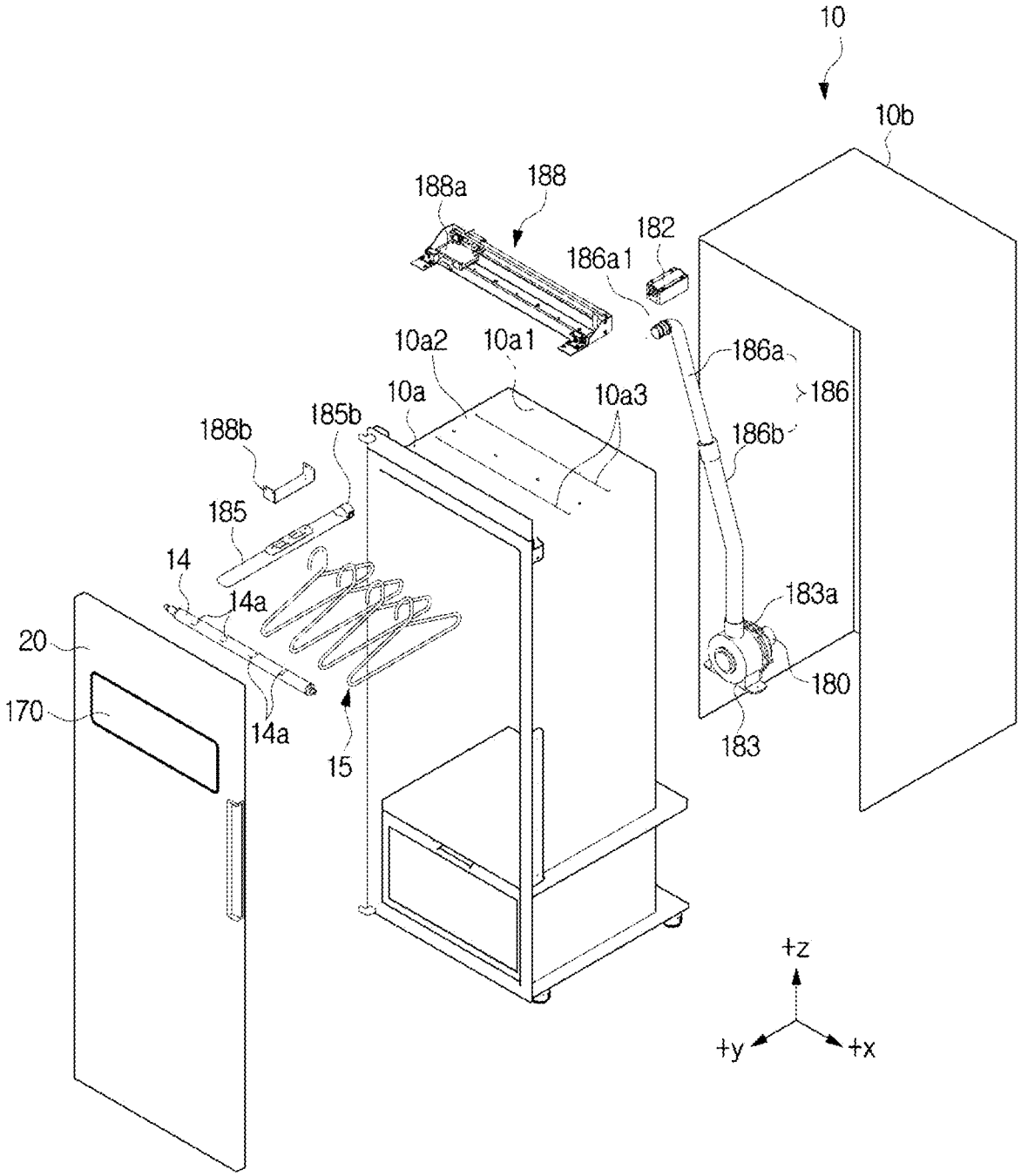
FIG. 4 illustrates a schematic exploded view of a clothes treating apparatus, according to an embodiment of the present disclosure.

FIG. 4 illustrates a schematic exploded view of a clothes treating apparatus, according to an embodiment of the present disclosure.

Referring to FIG. 4, the main body 10 of the clothes treating apparatus 100 includes the inner case 10*a* and the outer case 10*b*. The fan or the first fan 183 may be located between the back of the inner case 10*a* and the outer case 10*b*. The fan 183 may receive driving force from the first motor 180.

A rotation velocity of the fan 183 may be determined under the control of the controller 110. The rotation velocity of the fan 183 may be determined depending on at least one of a garment processing option or menu corresponding to the user's input, a garment type, the number of garments, and the extent of contamination inside the garment container 11.

The air accelerated by the fan 183 may be transferred to the nozzle unit 185 through the hose 186 coupled to the outlet 183*a*. The hose 186 may be implemented with a pipe 186*a* and a flexible hose 186*b*. The pipe 186*a* may be a hard pipe. One end of the flexible hose 186*b* may be fixed to the outlet 183*a* of the fan 183. The other end of the flexible hose 186*b* may be coupled to an end of the pipe 186*a*. The other end of the flexible hose 186*b* and the one end of the pipe 186*a* may be coupled by fitting or a fastening member such as a screw, a rivet, or an adhesive.

The other end of the pipe 186*a* may be shaped like an elbow tube. The air supplied from the one end of the pipe 186*a* coupled to the other end of the flexible hose 186*b* may be changed to a set angle, e.g., ranging from about 45° to about 135° through the elbow tube and may be supplied to the other end of the pipe 186*a*.

The other end of the pipe 186*a* may be coupled to an end, e.g., an air inlet 185*b*, of the nozzle unit 185 coupled to the nozzle transportation unit 188 through the opening 10*a*1 of the inner case 10*a*. The air accelerated from the fan 183 may be sprayed into the garment container 11 through the hose 186 and the nozzle 185*a* of the nozzle unit 185.

Figure 5:
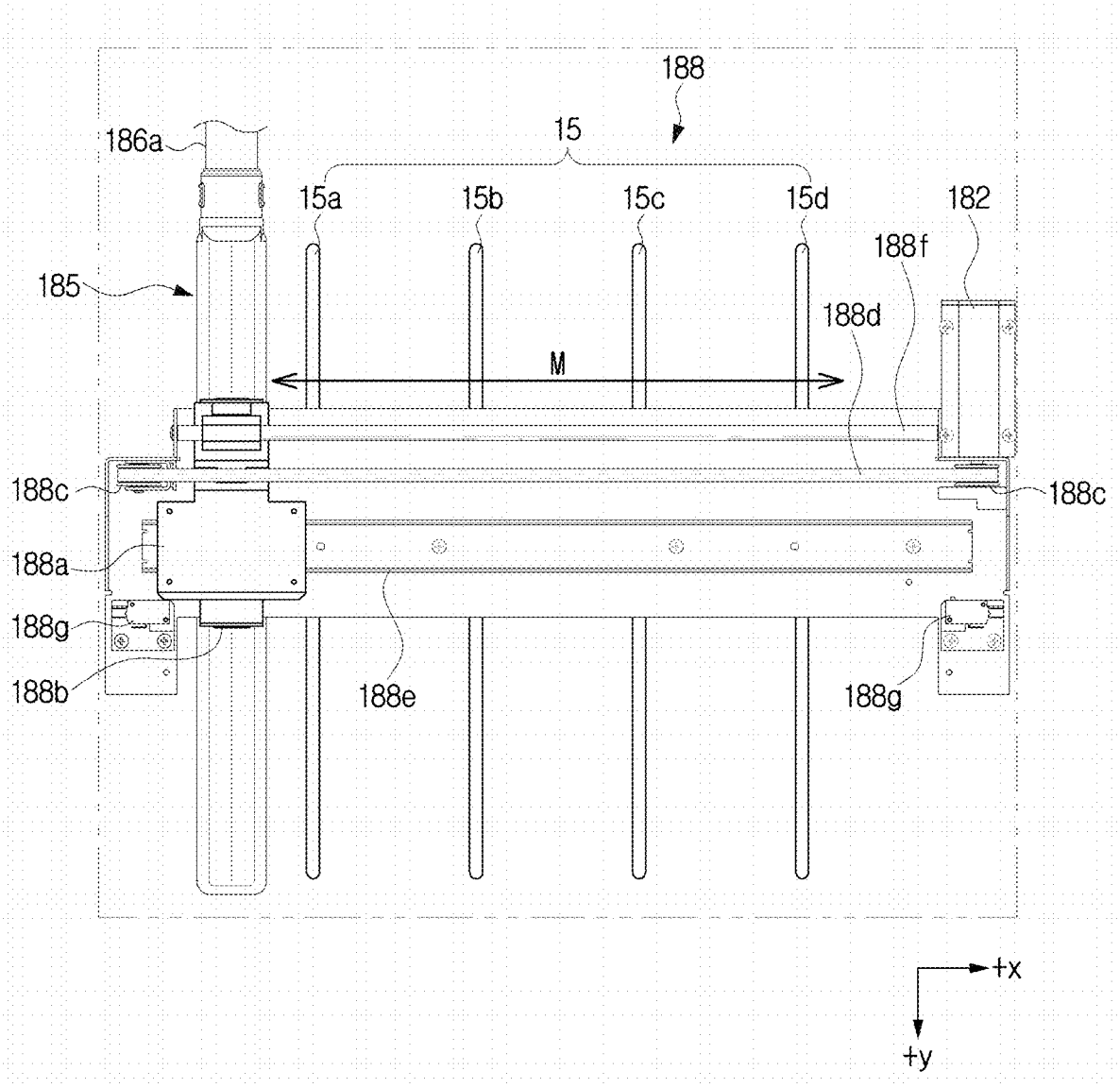
FIG. 5 illustrates a schematic plan view of a nozzle transportation unit of a clothes treating apparatus, according to an embodiment of the present disclosure.

FIG. 5 illustrates a schematic plan view of a nozzle transportation unit of a clothes treating apparatus, according to an embodiment of the present disclosure.

Figure 6:
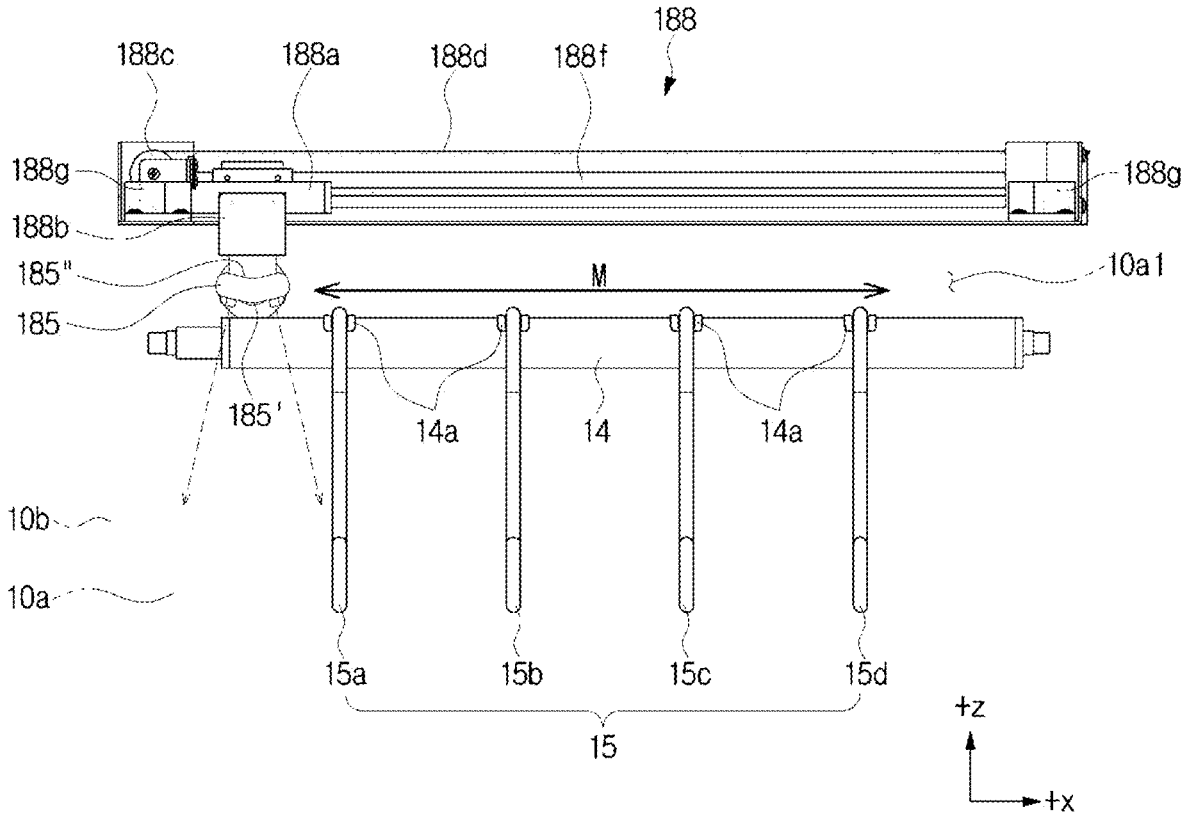
FIG. 6 illustrates a schematic front view of a nozzle transportation unit of a clothes treating apparatus, according to an embodiment of the present disclosure.

FIG. 6 illustrates a schematic front view of a nozzle transportation unit of a clothes treating apparatus, according to an embodiment of the present disclosure.

Figure 7:
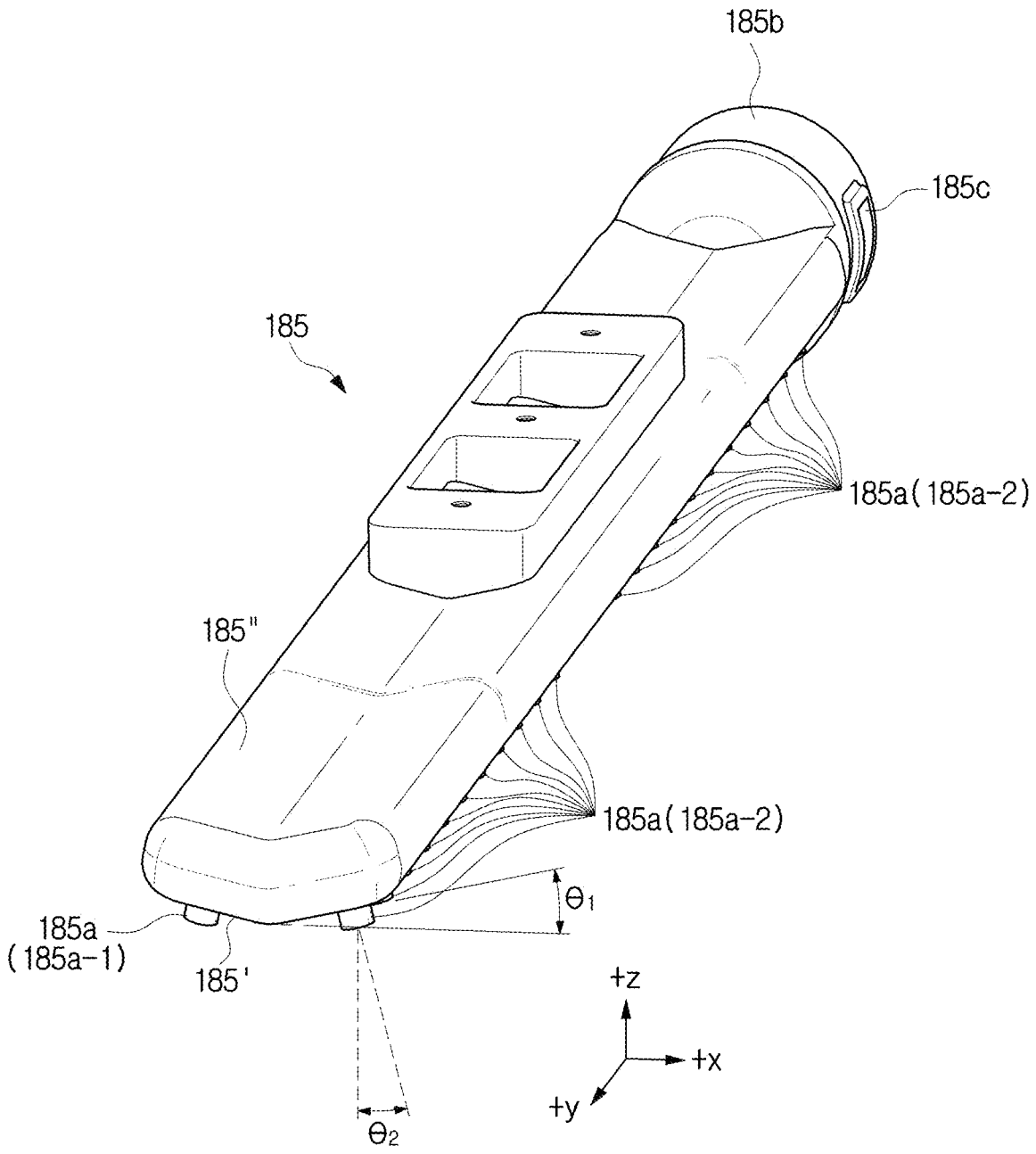
FIG. 7 illustrates a schematic perspective view of a nozzle unit of a clothes treating apparatus, according to an embodiment of the present disclosure.

FIG. 7 illustrates a schematic perspective view of a nozzle unit of a clothes treating apparatus, according to an embodiment of the present disclosure.

Figure 8:
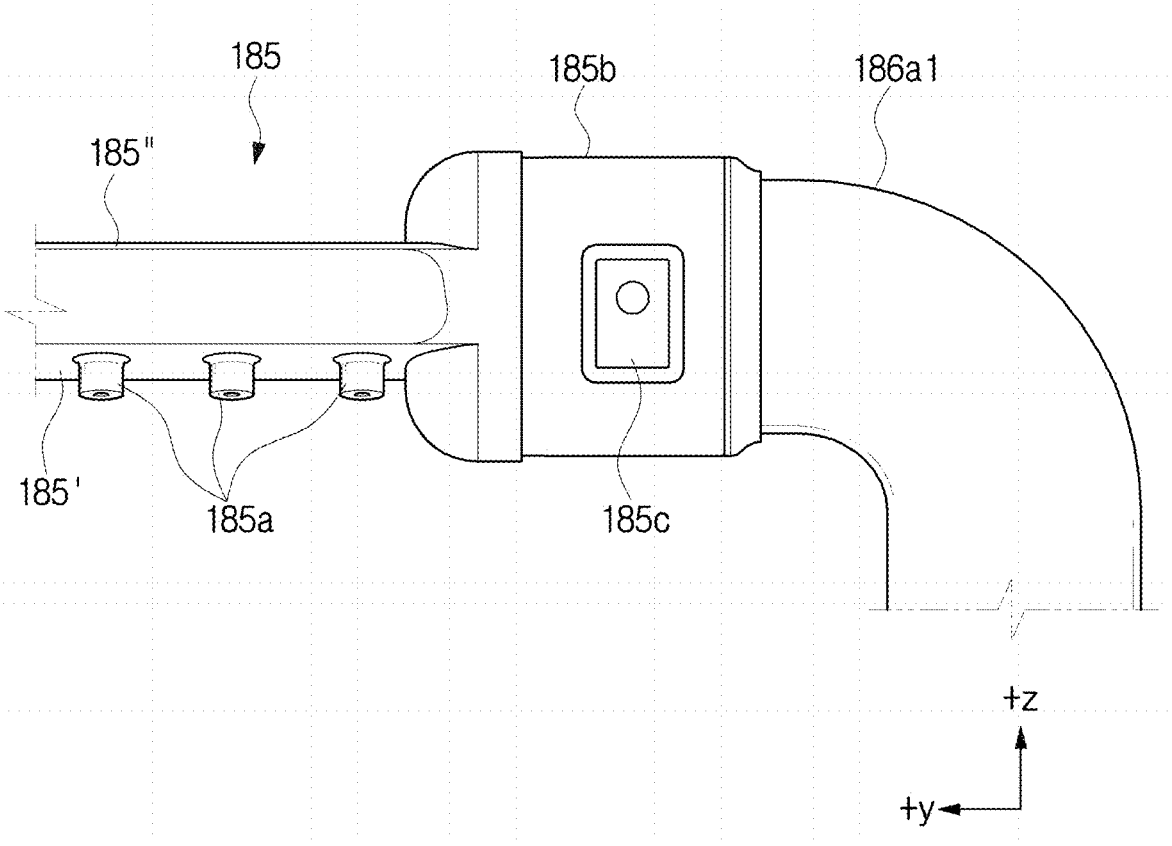
FIG. 8 illustrates a schematic perspective view of a coupling portion between a nozzle unit and a hose in a clothes treating apparatus, according to an embodiment of the present disclosure.

FIG. 8 illustrates a schematic perspective view of a coupling portion between a nozzle unit and a hose in a clothes treating apparatus, according to an embodiment of the present disclosure.

Referring to FIGS. 4 to 6, the nozzle transportation unit 188 may be located between the inner case 10*a* and the outer case 10*b*. The nozzle transportation unit 188 may be fixed to a surface 10*a*2 of the inner case 10*a* by a fastening member such as a screw, a rivet, or an adhesive.

There may be a recess 10*a*3 formed on the surface 10*a*2 of the inner case 10*a* in the width direction, e.g., a direction in which the moving block 188*a* makes reciprocating motion. The recess 10*a*3 may be a single or multiple in number. The width of the recess 10*a*3 should be as wide as a bracket 188*b* coupled to the moving block 188*a* of the nozzle transportation unit 188 is movable therein.

The nozzle transportation unit 188 may include the moving block 188*a*, the bracket 188*b* coupled to the moving block 188*a* and the nozzle unit 185, the pulley 188*c* that rotates by the driving force received from the third motor 182, the belt 188*d* contacting the pulley 188*c* and moving in the direction of rotation of the pulley 188*c*, the rail 188*e* which is in a reciprocating path of the moving block 188*a*, and/or a stabilizer bar 188*f* for stable movement of the moving block 188*a*. The pulley 188*c* and the belt 188*d* may allow the moving block 188*a* to be moved in the reciprocating direction M, e.g., along the ±x-axis by the driving force of the third motor 182.

The nozzle transportation unit 188 may be located at both ends of the rail 188*e* and may include stoppers 188*g* (or switches) to limit the movement of the moving block 188*a*. The stabilizer bar 188*f* may be referred to as a guide bar.

The bracket 188*b* and the moving block 188*a* coupled to the nozzle unit 185 may make reciprocating motion along the rail 188*e* under the control of the controller 110. In embodiments of the present disclosure, the reciprocating motion of the bracket 188*b* and the moving block 188*a* coupled to the nozzle unit 185 may lead to reciprocating motion of the nozzle unit 185.

The bracket 188*b* and the moving block 188*a* coupled to the nozzle unit 185 (or the nozzle unit 185 itself) may make reciprocating motion along the rail 188*e* between stoppers 188*g* under the control of the controller 110. For example, the distance between the stoppers 188*g* may be about 440 mm. In another example, the distance between the stoppers 188*g* may be about 550 mm or less. In yet another example, the distance between the stoppers 188*g* may be about 110 mm or more and about 650 mm or less. In still another example, the distance between the stoppers 188*g* may be about 310 mm or more and about 990 mm or less. The distance between the stoppers 188*g* may be narrower than the width of the clothes treating apparatus 100. The distance between the stoppers 188*g* as mentioned above is only by way of example, and may be changed depending on the width of the clothes treating apparatus 100.

When at least one of the bracket 188*b* and the moving block 188*a* comes into contact with the stopper 188*g* or approaches the stopper 188*g*, which is detected by the proximity sensor, the controller 110 may control the operation of the third motor 182 e.g., to be paused. The operation of the belt 188*d* and the pulley 188*c* may be stopped by controlling the operation of the third motor 182. With the stop operation of the belt 188*d* and the pulley 188*c*, the movement of the bracket 188*b* and the moving block 188*a* coupled to the nozzle unit 185 may be stopped. In embodiments of the present disclosure, stopping of the movement of the bracket 188*b* and the moving block 188*a* coupled to the nozzle unit 185 may lead to stopping of the motion of the nozzle unit 185.

The bracket 188*b* and the moving block 188*a* coupled to the nozzle unit 185 (or the nozzle unit 185 itself) may make reciprocating motion along the rail 188*e* between stoppers 188*g* at a set speed, under the control of the controller 110. For example, the set speed (also referred to as a 'first set speed') may be about 110 mm/s or less. In another example, the set speed may be about 10 mm/s or more and about 200 mm/s or less. The set speed may be a speed to move the distance between the stoppers 188*g* in a second. The set speed may include a second set speed higher than the first set speed and/or a third set speed lower than the first set speed. For example, if the set speed is about 110 mm/s, the second set speed may be higher than 100 mm/s and the third set speed may be lower than 110 mm/s.

At least one of the set speed and the distance of movement of the bracket 188*b* and the moving block 188*a* coupled to the nozzle unit 185 may be changed under the control of the controller 110. In embodiments of the present disclosure, the set speed for the bracket 188*b* and the moving block 188*a* coupled to the nozzle unit 185 may imply the speed set for the nozzle unit 185. Furthermore, the distance of movement of the bracket 188*b* and the moving block 188*a* coupled to the nozzle unit 185 may imply the distance of movement of the nozzle unit 185.

Both ends of the bar 14 located on the upper end of the garment container 11 may be fixed to both sides of the garment container 11. The bar 14 may be located under the nozzle transportation unit 188 e.g., in the direction of gravity. The nozzle unit 185 may make reciprocating motion along the length of the bar 14. The nozzle unit 185 may make reciprocating motion along the bar 14 to intersect with the direction of gravity.

The nozzle unit 185 moving or making reciprocating motion to intersect with the direction of gravity may mean the nozzle unit 185 slantingly transported by the nozzle transportation unit 188 at a set angle from the direction of gravity. The set angle may be an angle of the bar 14 fixed to the both sides of the garment container 11 from the direction of gravity. Alternatively, the set angle may be the right angle with an allowable error of ±1.5° or less, which is perpendicular to the direction of gravity.

A plurality of grooves 14*a* in which the hangers 15 are hung may be formed on the bar 14. One or more hangers 15 may be hung in the grooves 14*a* of the bar 14. The garments hung on the hangers 15 may be swayed by air jets sprayed from the nozzle 185*a* in the direction of nozzle transportation, e.g., along the ±x-axis. The extent of swaying of the garments may depend on the spraying intensity or pressure of the air jets.

If it is determined through the indoor camera 150 that the number of the garments hung on the hangers 15 is 3 or less, the controller 110 may reduce the distance of movement of the bracket 188*b* and the moving block 188*a* coupled to the nozzle unit 185 (e.g., in comparison with a case that there are 4 garments).

When a garment process option is input by the user as 'urgent', the controller 110 may change the set speed of the bracket 188*b* and the moving block 188*a* coupled to the nozzle unit 185 to a higher speed, e.g., to the second set speed.

If it is determined through the indoor camera 150 that the garment is significantly contaminated or if the garment process option is input by the user as 'significantly contaminated', the controller 110 may change the set speed of the bracket 188*b* and the moving block 188*a* coupled to the nozzle unit 185 to a lower speed, e.g., to the third set speed.

Specifically, if it is determined through the indoor camera 150 that the garment is significantly contaminated or if the garment process option is input by the user as 'significantly contaminated', the controller 110 may change the set speed of the bracket 188*b* and the moving block 188*a* coupled to the nozzle unit 185 to the third set speed and control the number of rotations of the fan 183, enabling a high rate of air jets or air jets with the pressure higher than the atmospheric pressure to be sprayed to the significantly contaminated garment. The spraying rates of air jets may be categorized into high rate, medium rate, and low rate. The low rate of air jets may be about 3 m/s or less. The medium rate of air jets may be about 6 m/s or less. The high rate of air jets may be about 10 m/s or less. The spraying rate of air jets may be changed depending on at least one of the number of nozzles of the nozzle unit 185, the diameter of the nozzle, the fan 183, and the first motor 180.

If it is determined through the camera 150 that the number of garments hung on the hangers is 3 or less and the garment process option is input by the user as 'urgent', the controller 110 may change both the distance of movement and the set speed for the bracket 188*b* and the moving block 188*a* coupled to the nozzle unit 185.

Referring to FIG. 7, the nozzle unit 185 may include the nozzle 185*a* and the air inlet 185*b*. The nozzle unit 185 may have a 'V' shaped section. The nozzle unit 185 may have an open structure at one end due to the air inlet 185*b* and a closed structure at the other end.

The nozzle 185*a* located on the bottom 185' of the nozzle unit 185 may be about 2 mm in diameter. The diameter of the nozzle 185*a* may be about 0.5 mm or more and about 5 mm or less. There may be two, three, or more arrays of nozzles 185*a*.

The diameter of the nozzle 18*a* may depend on the array. For example, nozzles 185*a*-1 in a first array and nozzles 185*a*-2 in a second array may have different diameter. The nozzles 185*a*-1 in the first array, the nozzles 185*a*-2 in the second array, and nozzles 185*a*-3 (not shown) in the third array between the first and second arrays of nozzles may have different diameter. The nozzles 185*a*-1 in the first array, the nozzles 185*a*-2 in the second array, the nozzles 185*a*-3 in the third array left to the first array of nozzles and nozzles 185*a*-4 (not shown) in the fourth array right to the second array of nozzles may have different diameters. Alternatively, some of the plurality of arrays of nozzles, e.g., the first and second arrays of nozzles, may have the same diameter, and the remaining arrays of nozzles, e.g., the third and fourth arrays of nozzles, may have the same diameter.

There may be a total of 44 nozzles 185*a*. The total number of nozzles 185*a* may depend on the number of arrays. The number of nozzles 185*a* in each array may not or may be the same.

The bottom 185' of the nozzle unit 185 is slanted at a set angle θ1 from the direction of gravity. The set angle θ1 may be an acute angle. The set angle θ1 may be about 28° or less. More specifically, the set angle θ1 may be about 8° or more and 19° or less.

The nozzles 185*a* may be located on the bottom 185' of the nozzle unit 185 slanted at the set angle θ1.

A jet angle θ2 of the nozzle 185*a* may be an acute angle. The jet angle θ2 of the nozzle 185*a* may refer to a jet angle of air jets from the nozzle 185*a*. The jet angle θ2 may be about 28° or less. More specifically, the jet angle θ2 may be about 8° or more and 19° or less. The jet angle θ2 of the nozzle 185*a* may be different for each nozzle in an array, e.g., the first array. The jet angle θ2 of the nozzle 185*a* may be different for each array of nozzles, e.g., for each of the first array, the second array, the third array, and more.

The jet angle θ2 of the nozzle 185*a* may not or may be the same as the set angle θ1 of the nozzle 185*a*.

The nozzles arranged in multiple arrays in the nozzle unit 185 may have different jet angles θ2. With the different jet angles, e.g., ±θ2 from the direction of gravity, air jets may be sprayed in two or more directions. Furthermore, the nozzles arranged in one array may also spray air jets in different directions, e.g., in two or more directions. For example, nozzles alternately arranged in one array, e.g., at ±θ2 with respect to the direction of gravity, may also spray air jets in two or more directions. The garments hung on the hangers 15 may be moved or swayed by the air sprayed from the nozzle 185*a* along the direction of transportation of the nozzle unit from the direction of gravity. The garments hung on the hangers 15 may make reciprocating motion or may be swayed like the pendulum motion due to the air sprayed from the nozzles 185*a* in both directions.

The elements 188*a* to 188*f* of the nozzle transportation unit 188 are by way of example, and may be added, modified and/or deleted depending on the structure of the nozzle transportation unit 188 and/or the transportation speed.

Referring to FIG. 8, the nozzle unit 185 and the hose 186 are coupled together. An end 186*a*1 of the pipe 186*a* of the hose 186 may be coupled to the air inlet 185*b* of the nozzle unit 185.

In this case, a button 185*c*, which has not been coupled, may be coupled, e.g., the button 185*c* may come up. As the nozzle unit 185 is moved, the one end 186*a*1 of the pipe 186*a* may be rotated clockwise or counterclockwise. In response to the movement of the nozzle unit 185, the hose 186 may work with a counter reaction to the movement of the nozzle unit 185. In response to the movement of the nozzle unit 185, the flexible hose 186*b* of the hose 186 may work with a counter reaction, e.g., tensile force, to the movement of the nozzle unit 185. As the nozzle unit 185 is moved, the one end 186*a*1 of the pipe 186*a* may closely contact the air inlet 185*b* of the nozzle unit 185 or may be sealed in the air inlet 185*b*.

When the user pushes the button 185*c*, the one end 186*a*1 of the pipe 186*a* may be separated from the air inlet 185*b* of the nozzle unit 185.

Figure 9:
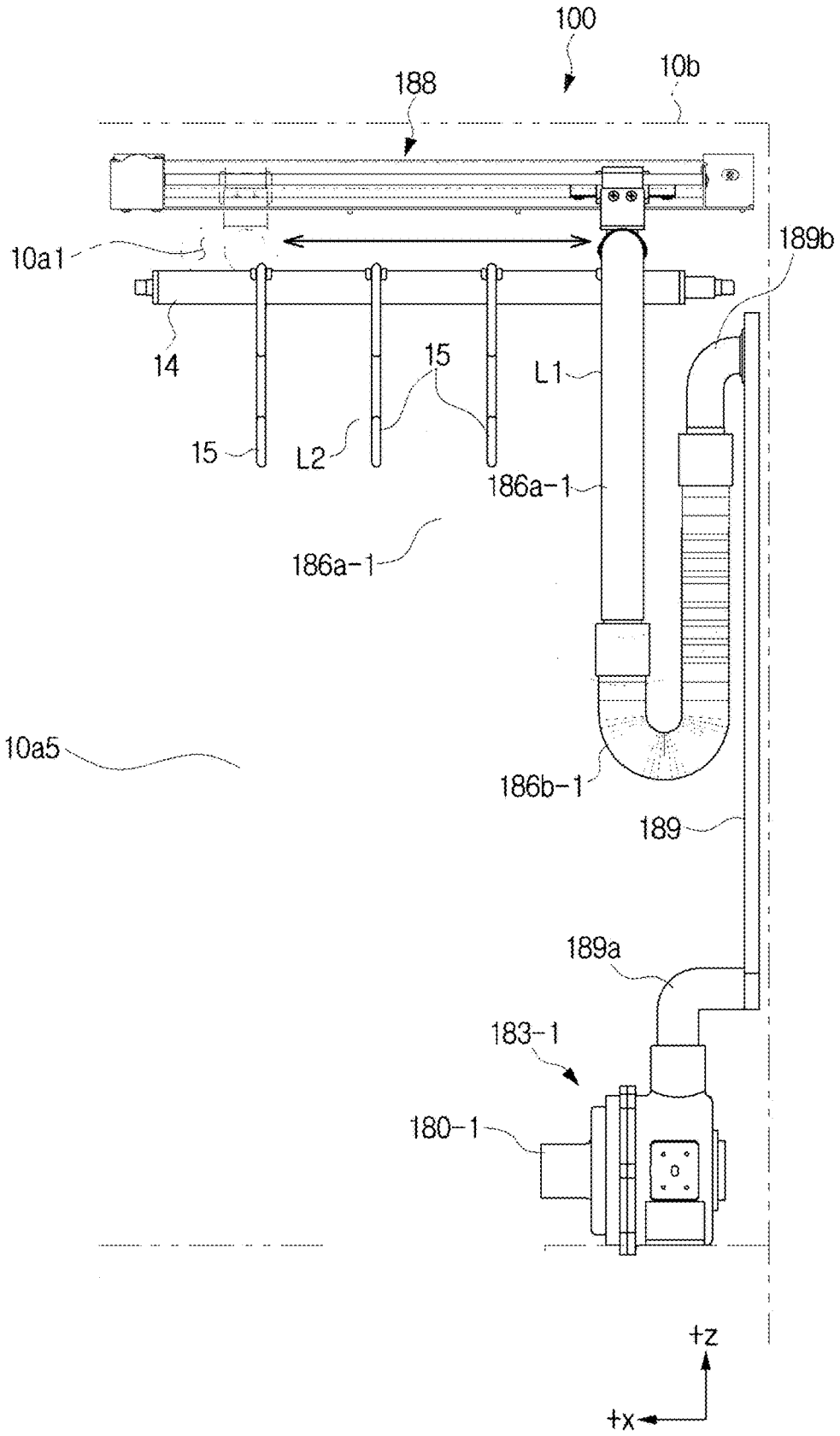
FIG. 9 illustrates a schematic rear view representing a location of a fan of a clothes treating apparatus, according to an embodiment of the present disclosure.

FIG. 9 illustrates a schematic rear view representing a location of a fan of a clothes treating apparatus, according to an embodiment of the present disclosure.

Referring to FIG. 9, a first motor 180-1 and a first fan 183-1 may be located between the inner case 10*a* and the outer case 10*b*. The first motor 180-1 and the first fan 183-1 may be located on a side of the bottom of the back 10*a*5 of the inner case 10*a*.

An outlet 183*a*-1 of the first fan 183-1 may be coupled to one end of a duct 189 through an elbow tube 189*a*. The other end of the duct 189 may be coupled to a hose 186-1 through an elbow tube 189*b*. The other end of the duct 189 may be coupled to a flexible hose 186*b*-1 of the hose 186-1 through the elbow tube 189*b*. The flexible hose 186*b*-1 may be coupled to one end of a pipe 186*a*-1. The other end of the pipe 186*a*-1 may be coupled to the air inlet 185*b* of the nozzle unit 185. The air accelerated from the first fan 183-1 may be supplied to the nozzle unit 185 through the duct 189 and the hose 186*a*-1. The flexible hose 186*b*-1 coupled to the duct 189 and the pipe 186*a*-1 may be shaped like the letter 'U'.

When the nozzle unit 185 is moved, the entire length of the hose 186-1 or the entire length of the pipe 186*a*-1 and the flexible hose 186*b*-1 may be constant. Specifically, when the nozzle unit 185 is moved from a first position L1 to a second position L2, the entire length of the hose 186-1 or the entire length of the pipe 186*a*-1 and the flexible hose 186*b*-1 may remain the same. For example, the entire length of the hose 186-1 at the first position L1 may be L mm. The entire length of the hose 186-1 at the second position L1 may also be L mm.

Figure 10:
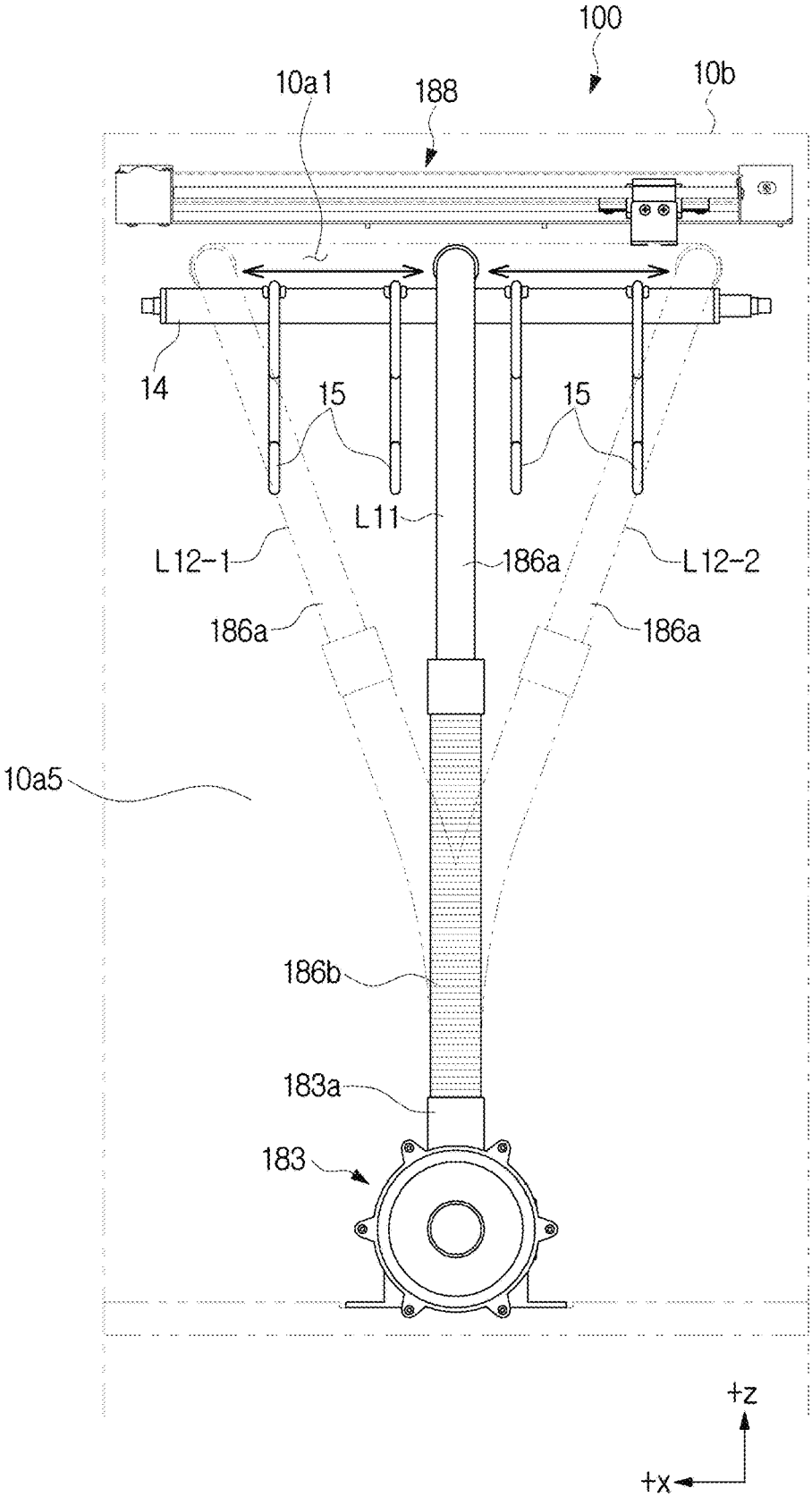
FIG. 10 illustrates a schematic rear view representing a location of a fan of a clothes treating apparatus, according to another embodiment of the present disclosure.

FIG. 10 illustrates a schematic rear view representing a location of a fan of a clothes treating apparatus, according to another embodiment of the present disclosure.

Referring to FIG. 10, the first motor 180 and the first fan 183 may be located between the inner case 10*a* and the outer case 10*b*. The first motor 180 and the first fan 183 may be located in the middle area with respect to the bottom of the back 10*a*5 of the inner case 10*a*.

The outlet 183*a* of the first fan 183 may be coupled to one end of the flexible hose 186*b* of the hose 186. The other end of the flexible hose 186*b* may be coupled to one end of the pipe 186*a*. The other end of the pipe 186*a* may be coupled to the air inlet 185*b* of the nozzle unit 185. The air accelerated from the first fan 183-1 may be supplied to the nozzle unit 185 through the pipe 186*a* and hose 186*b* without the duct 189.

The flexible hose 186*b*-1 coupled to the outlet 183*a* of the first fan 183 and the pipe 186*a* may have a linear form. When the nozzle unit 185 is moved, the entire length of the hose 186 or the entire length of the pipe 186*a* and the flexible hose 186*b* may vary. Specifically, when the nozzle unit 185 is moved from a position L11 to another position L12-1 or L12-2, the entire length of the hose 186 or the entire length of the pipe 186*a* and the flexible hose 186*b* may vary.

If the position L11 of the nozzle unit 185 is a reference position, e.g., '0', the position L12-1 or L12-2 may be ± about 220 mm away from the position L11. When the position L11 is the reference position, e.g., '0', the distance from the position L11 to the position L12-1, L12-2 may depend on the size and/or performance of the clothes treating apparatus 100.

The pipe 186*a* of the hose 186 may have a property of rigid body. When the nozzle unit 185 is moved from the position L11 to the position L12-1, L12-2, the entire length of the pipe 186*a* may be constant. When the nozzle unit 185 is moved from the position L11 to the position L12-1, L12-2, the entire length of the flexible hose 186*b* with elasticity may vary. For example, the entire length of the hose 186 at the position L11 may be L mm. The entire length of the hose 186 at the position L12-1, L12-2 may be L+ΔL mm. The extent of change ΔL may be calculated using Pythagorean theorem.

When the nozzle unit 185 is moved from the position L11 to the position L12-1, L12-2, the entire length of the flexible hose 186*b* with elasticity may vary depending on the distance between the position L11 and the position L12-1, L12-1.

The clothes treating apparatus in accordance with embodiments of the present disclosure may include a main body having a garment container, a door hinged with the main body to be rotated in front of the garment container and having a display on the front side of the door, a nozzle unit having a nozzle configured to spray air to a garment contained in the garment container, a nozzle transportation unit configured to reciprocate the nozzle unit, and a hose supplying air from a fan located on the bottom of the main body to the nozzle unit, and a distance of movement of the nozzle unit is shorter than the width of the main body.

A bar on which a hanger is hung may be located in the garment container under the nozzle unit in the direction of gravity A camera configured to take an image of the inside of the garment container may be located on the rear side of the door.

The main body may include an inner case and an outer case, and the nozzle transportation unit may be located between the inner case and the outer case.

The nozzle transportation unit may include a pulley rotating by power of a motor, a belt moving while contacting the pulley, a moving block moving on a rail by the belt, and a bracket coupling the nozzle unit to the moving block.

The nozzle transportation unit may further include stoppers at both ends of the rail for limiting the movement of the moving block.

A portion of the bracket may be coupled to the nozzle unit by penetrating the inner case of the main body from outside of the inner case.

The nozzle unit may have an open structure at one end to receive air from the hose and a closed structure at the other end, and a plurality of nozzles may be formed on the bottom of the nozzle unit.

The bottom of the nozzle unit may be slanted at a first set angle, which is an acute angle, from the direction of gravity.

The nozzles may be arranged in one of a single array and multiple arrays on the bottom of the nozzle unit slanted at the first set angle.

The nozzle may spray air while being slanted at a second set angle, which is an acute angle, from the direction of gravity.

The first set angle may not or may be the same as the second set angle.

In response to reciprocating motion of the nozzle unit, the entire length of the hose connected from the fan located in a middle area on the bottom of the main body to the nozzle unit may vary due to elasticity of a portion of the hose.

When the fan is located on a side of the bottom of the main body, the entire length of the hose connected from the fan to the nozzle unit may be constant.

A groove may be formed on the bar to receive the hanger, and the garment hung on the hanger received in the groove may be swayed by the air sprayed from the nozzle of the nozzle unit.

As discussed below, methods according to various embodiments of the present disclosure may be implemented in program instructions which are executable by various computing means and recorded in computer-readable media. The computer-readable media may include program instructions, data files, data structures, etc., separately or in combination. For example, the computer-readable recording media may include, no matter whether it is erasable or rewritable, volatile or non-volatile storage devices, such as RAM, ROM, magnetic storage media (e.g., floppy disks, hard disks, etc.), and optical recording media (e.g., CD-ROMs, or DVDs). The computer-readable recording medium may also be distributed over network coupled computer systems so that the computer readable code is stored and executed in a distributed fashion. This media may be read by the computer, stored in the memory, and executed by the processor. The computer-readable program may be stored in a computer-readable storage medium of a server, and may be downloaded to a computing device over a network.

The memory included in the clothes treating apparatus may be an example of the computer-readable recording medium suitable for storing a program or programs having instructions that implement the embodiments of the present disclosure. The program instructions recorded on the computer-readable media may be designed and configured specially for the present disclosure, or may be well-known to people having ordinary skill in the art of computer software.

According to embodiments of the present disclosure, a clothes treating apparatus capable of processing garments hung on hangers in a garment container by spraying air jets from a nozzle in a movable nozzle unit.

According to embodiments of the present disclosure, a clothes treating apparatus capable of managing garments hung on hangers in a garment container by using air jets sprayed from a nozzle in a reciprocating nozzle unit.

According to embodiments of the present disclosure, a clothes treating apparatus capable of dealing with at least one of dirt, odor, and contamination of clothes hung on hangers in a garment container by spraying air jets from a nozzle in a movable nozzle unit.

According to embodiments of the present disclosure, a clothes treating apparatus capable of dealing with at least one of dirt, odor, and contamination of clothes hung on hangers in a garment container by using air jets sprayed from a nozzle in a reciprocating nozzle unit.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothes treating apparatus comprising:

a main body including an inner case forming a garment container and an outer case forming an exterior of the clothes treating apparatus, the garment container comprising a top plate, a bottom plate, a first side wall, a second side wall, and a rear wall connected between the first side wall and the second side wall;

a door hinged with the main body, configured to be rotated in front of the garment container and including a display on a front side of the door;

a nozzle unit including a nozzle configured to spray air to a garment contained in the garment container;

a nozzle transportation unit mounted to the top plate of the garment container and configured to reciprocate the nozzle unit;

a fan disposed between the inner case and the outer case;

a hose configured to supply air from the fan to the nozzle unit;

a pipe connected between the nozzle unit and the hose; and a bar configured to receive a hanger, a first end of the bar mounted to the first side wall and a second end of the bar mounted to the second side wall, wherein the nozzle unit is disposed higher than the bar and reciprocates along a length of the bar so that the nozzle blows air toward the bottom plate, wherein the pipe is coupled to one end of the nozzle unit through an opening of the rear wall.

2. The clothes treating apparatus of claim 1, wherein the door comprises a camera on a rear side configured to capture an inside of the garment container.

3. The clothes treating apparatus of claim 1, wherein:

the main body comprises an inner case and an outer case, and the nozzle transportation unit is located between the inner case and the outer case.

4. The clothes treating apparatus of claim 1, wherein the nozzle transportation unit comprises:

a pulley configured to be rotated by power of a motor;

a belt configured to be moved by contacting the pulley;

a moving block configured to be moved on a rail by the belt; and a bracket configured to couple the nozzle unit to the moving block.

5. The clothes treating apparatus of claim 4, further comprising stoppers located at both ends of the rail configured to limit movement of the moving block.

6. The clothes treating apparatus of claim 4, wherein a portion of the bracket is coupled to the nozzle unit by penetrating the inner case of the main body from outside of the inner case.

7. The clothes treating apparatus of claim 1, wherein:

the nozzle unit includes:

an open structure at one end configured to receive the air from the hose, and a closed structure at another end, and a plurality of nozzles may be formed on a bottom of the nozzle unit.

8. The clothes treating apparatus of claim 1, wherein:

a bottom of the nozzle unit is slanted at a first set angle from a direction of gravity, and the first set angle is an acute angle.

9. The clothes treating apparatus of claim 8, wherein the nozzle is arranged in one of a single array or multiple arrays on the bottom of the nozzle unit slanted at the first set angle.

10. The clothes treating apparatus of claim 8, wherein:

the nozzle is configured to spray air while being slanted at a second set angle from the direction of gravity, and the second set angle is an acute angle.

11. The clothes treating apparatus of claim 10, wherein the first set angle is the same as or different from the second set angle.

12. The clothes treating apparatus of claim 1, wherein the bar includes a plurality of grooves formed thereon to seat the hanger.

13. A clothes treating apparatus comprising:

a main body including a garment container containing a garment hung on a hanger, the garment container comprising a top inner surface, a bottom inner surface, and both side inner surfaces;

a door hinged with the main body, configured to be rotated in front of the garment container and including a touch screen on a front side of the door;

a bar disposed across both side inner surfaces and configured to receive the hanger;

a nozzle unit disposed higher than the bar and including a nozzle configured to spray air to the garment hung on the hanger;

a nozzle transportation unit mounted to the top inner surface of the garment container and configured to reciprocate the nozzle unit along the bar;

a fan connected to a hose that is configured to supply the air to the nozzle unit and located on a bottom of the main body; and a controller configured to:

control the touch screen, the nozzle transportation unit, and the fan, use the nozzle transportation unit to reciprocate the nozzle unit to intersect with a direction of gravity in response to a user input received through the touch screen, and control the air supplied from the fan to be sprayed to the garment container through the nozzle of the nozzle unit coupled to the nozzle transportation unit.

14. The clothes treating apparatus of claim 13, further comprising a camera located on a rear side of the door, wherein the controller is configured to use the camera to change a distance of movement of the nozzle unit coupled to the nozzle transportation unit based on a number of garments contained in the garment container.

15. The clothes treating apparatus of claim 14, wherein the controller is configured to use the camera to change a set speed of the nozzle unit coupled to the nozzle transportation unit based on the number of garments contained in the garment container.

16. The clothes treating apparatus of claim 13, wherein the controller is configured to change a number of rotations of the fan that supplies the air, in response to the user input.

17. The clothes treating apparatus of claim 13, wherein the controller is configured to use a camera to change a set speed of the nozzle unit coupled to the nozzle transportation unit based on a number of garments contained in the garment container.

* * * * *